US006041845A

United States Patent [19]

Couch

[11] Patent Number: 6,041,845

[45] Date of Patent: Mar. 28, 2000

[54] GARAGE DOOR OPENING AND CLOSING SYSTEM

[76] Inventor: Ernest C. Couch, 14 Park Terrace Dr., Hannibal, Mo. 63401

[21] Appl. No.: 09/235,743

[22] Filed: Jan. 21, 1999

[51] Int. Cl.[7] ..... E05D 15/38

[52] U.S. Cl. ..... 160/201; 160/209; 49/199

[58] Field of Search ..... 160/201, 209, 160/188; 49/199; 16/63, 65, DIG. 1; 267/250

[56] References Cited

U.S. PATENT DOCUMENTS

| | | | |
|---|---|---|---|
| 1,641,472 | 9/1927 | Brown . | |
| 2,567,029 | 9/1951 | Sauter | 49/204 |
| 3,048,385 | 8/1962 | Reynolds | 49/199 |
| 3,704,548 | 12/1972 | Wiegleb | 49/199 |
| 4,018,005 | 4/1977 | Harris | 49/199 |
| 4,231,191 | 11/1980 | Ellmore | 49/199 |
| 4,597,224 | 7/1986 | Tucker | 49/199 |
| 4,891,908 | 1/1990 | Aquilina | 49/199 |
| 5,429,170 | 7/1995 | Nogaki | 160/201 |
| 5,544,691 | 8/1996 | Wandio | 49/199 |

*Primary Examiner*—Blair M. Johnson

[57] ABSTRACT

A new and improved garage door opening and closing system comprising a lower bar pivotably connected to the upper extent of a garage door. An associated intermediate bar is coupled with respect to the lower bar. An upper bar has an upper end pivotably connected to a door actuator. A piston is mounted to the lower end of the upper bar. A cylindrical housing encompasses the piston. An apertured upper cap at the top end of the housing slidably receives the upper bar. An apertured lower cap is releasably secured to the upper end of the intermediate rod. An upper coil spring is mounted between the piston and the upper cap. A lower coil spring is located between the piston and the lower cap.

1 Claim, 3 Drawing Sheets

FIG 1
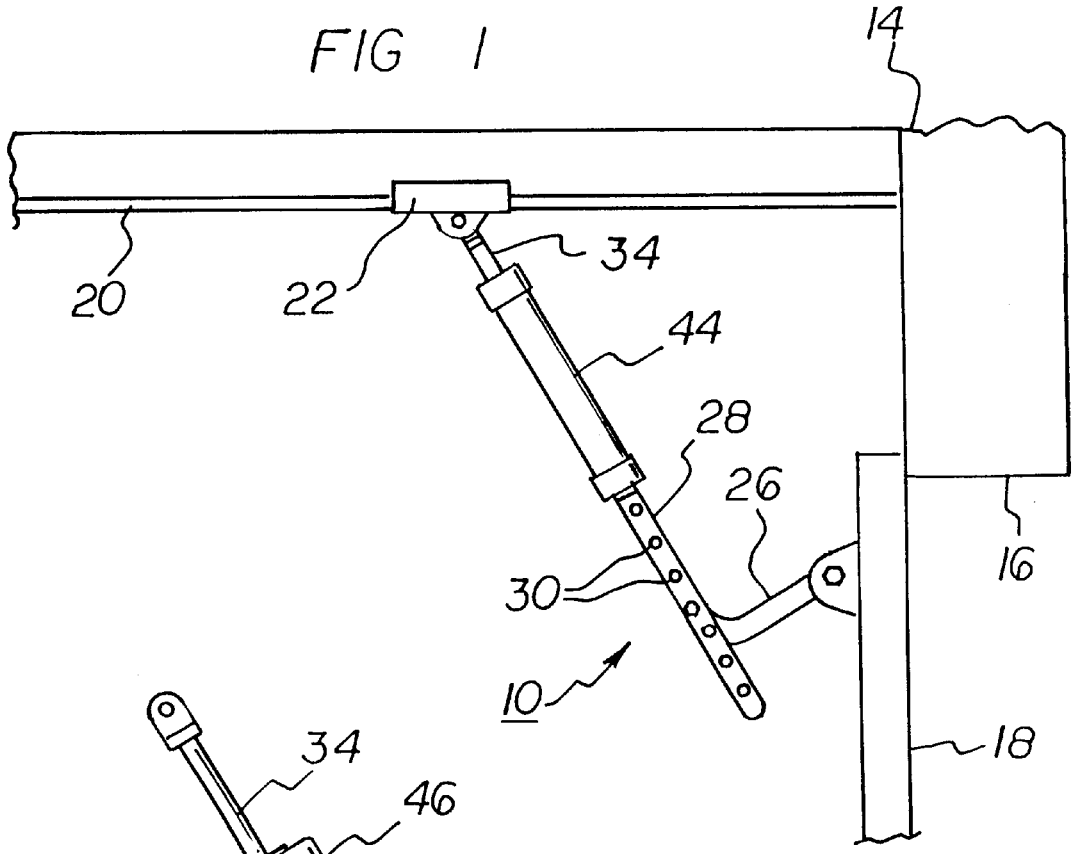
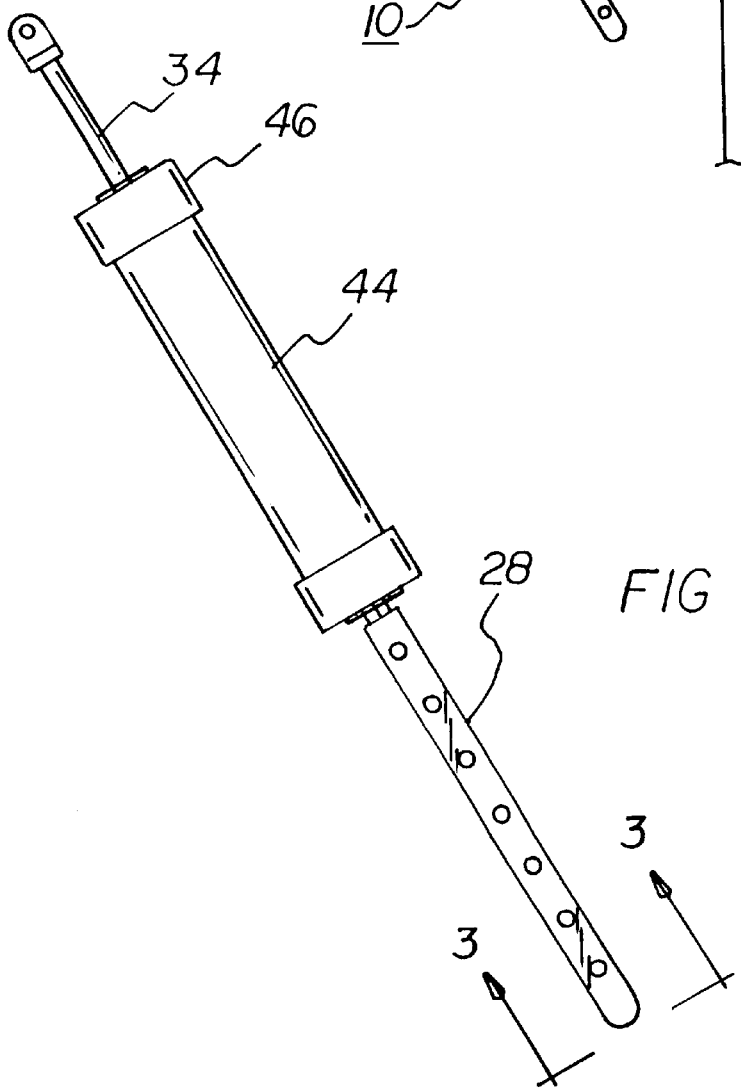
FIG 2

FIG 3
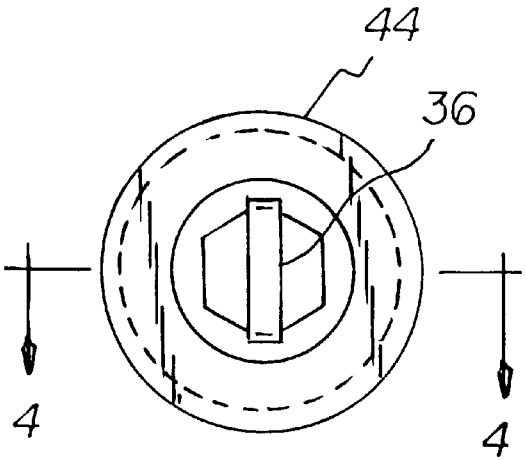
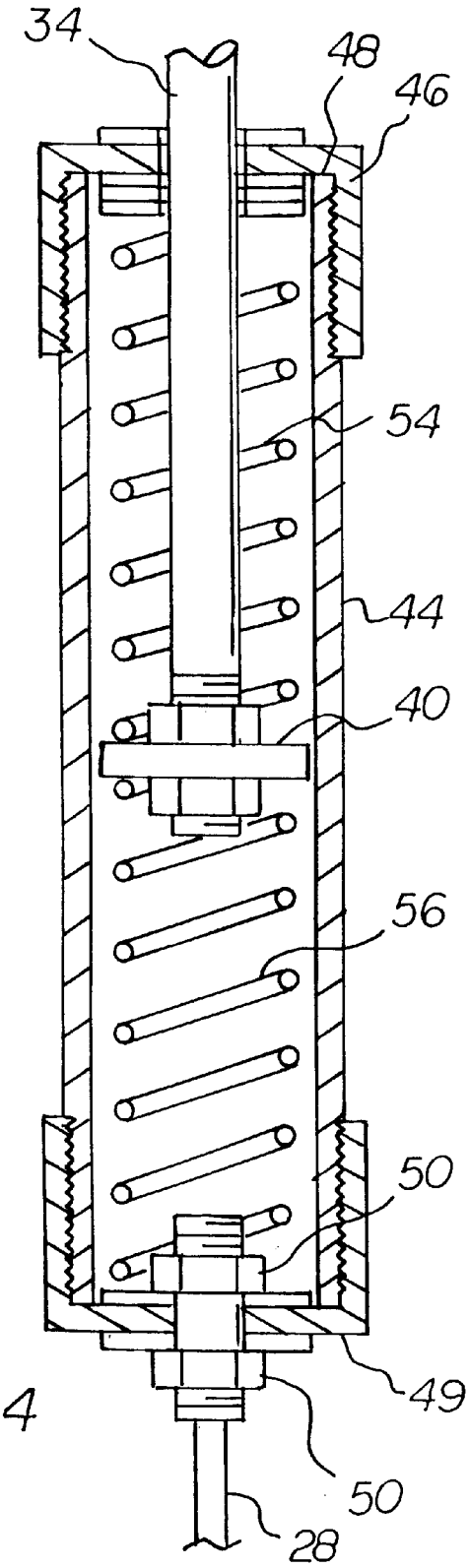
FIG 4

GARAGE DOOR OPENING AND CLOSING SYSTEM

BACKGROUND OF THE INVENTION

1. Field of the Invention

The present invention relates to a garage door opening and closing system and more particularly pertains to maximizing the convenience of garage door systems as well as their safety and quietness of operation.

2. Description of the Prior Art

The use of garage doors of known designs and configurations is known in the prior art. More specifically, garage doors of known designs and configurations heretofore devised and utilized for the purpose of increasing the efficiency of garage door systems through known methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 3,002,785 to K. Larche discloses a device for holding a cover of a vehicle opening in a desired position. U.S. Pat. No. 3,157,224 to J. E. Spargur, et al discloses a starting device for sliding doors. U.S. Pat. No. 3,757,845 to Pagliaro discloses an overhead stacked folding door. U.S. Pat. No. 3,856,073 to Risser discloses an overhead door movement control and support unit. U.S. Pat. No. 4,378,043to Sorensen discloses a pivoting screen panel for sectional garage door. U.S. Pat. No. 4,900,040, to Miller discloses a sealing device. Lastly, U.S. Pat. No. 5,188,163 to Schwartzengraber et al discloses a bracket assembly for an overhead door.

While these devices fulfill their respective, particular objectives and requirements, the aforementioned patents do not describe a garage door opening and closing system that allows maximizing the convenience of garage door systems as well as their safety and quietness of operation.

In this respect, the garage door opening and closing system according to the present invention substantially departs from the conventional concepts and designs of the prior art, and in doing so provides an apparatus primarily developed for the purpose of maximizing the convenience of garage door systems as well as their safety and quietness of operation.

Therefore, it can be appreciated that there exists a continuing need for a new and improved garage door opening and closing system which can be used for maximizing the convenience of garage door systems as well as their safety and quietness of operation. In this regard, the present invention substantially fulfills this need.

SUMMARY OF THE INVENTION

In view of the foregoing disadvantages inherent in the known types of garage doors of known designs and configurations now present in the prior art, the present invention provides an improved garage door opening and closing system. As such, the general purpose of the present invention, which will be described subsequently in greater detail, is to provide a new and improved garage door opening and closing system and method which has all the advantages of the prior art and none of the disadvantages.

To attain this, the present invention essentially comprises a new and improved garage door opening and closing system for increased convenience during installation and use and for maximizing safety and quietness of operation comprising, in combination a garage. The garage has a generally vertical opening. The garage has a garage door. The garage door is moveable between a closed position covering the opening and an elevated orientation to open the opening. A rail is horizontally positioned adjacent the top of the opening. The rail extends perpendicularly away from the top of the opening. Next provided is a slider. The slider is moveable along the rail to effect opening and closing of the door. Next provided is a lower bar. The lower bar is in a generally L-shaped configuration. The lower bar is pivotably connected to the door at an upper extent thereof. The lower bar is also connected to an associated intermediate bar. The intermediate bar is provided with apertures for coupling with respect to the lower bar at a preselected orientation. Next provided is an upper bar. The upper bar is in a cylindrical configuration. The upper bar has an upper end pivotably connected to the slider. The upper bar also has a threaded lower end. A piston is mounted to the upper bar by nuts. A cylindrical housing encompasses the piston. The cylindrical housing is provided with an apertured upper cap at the top end. The apertured upper cap slidably receives the upper bar. The cylindrical housing also has an apertured lower cap. The lower cap is releasably secured to the upper end of the intermediate rod by nuts. Lastly provided are an upper coil spring and a lower coil spring. The upper coil spring is mounted between the piston and the upper cap. The lower coil spring is located between the piston and the lower cap. In this manner motion of the slider toward the door will urge the upper, lower and intermediate rods and cylinder as well as the door downwardly with the urging of the piston toward the lower coil spring and with the piston adapted to locate itself between the springs upon the final sealing of the lower edge of the door within the opening.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved garage door opening and closing system which has all of the advantages of the prior art garage doors of known designs and configurations and none of the disadvantages.

It is another object of the present invention to provide a new and improved garage door opening and closing system which may be easily and efficiently manufactured and marketed.

It is further object of the present invention to provide a new and improved garage door opening and closing system which is of durable and reliable constructions.

An even further object of the present invention is to provide a new and improved garage door opening and closing system which is susceptible of a low cost of manufacture with regard to both materials and labor, and which accordingly is then susceptible of low prices of sale to the consuming public, thereby making such garage door opening and closing system economically available to the buying public.

Even still another object of the present invention is to provide a garage door opening and closing system for maximizing the convenience of garage door systems as well as their safety and quietness of operation.

Another object of the present invention is to provide an easily installed component on to both new and existing garage doors, particularly garage doors operated through an electric garage door opener.

Another object of the present invention is to maintain a light spring-loaded pressure on garage doors when in the closed position to thereby eliminate or reduce the rattling of the garage door as might be otherwise caused by strong winds or the like.

Another object of the present invention is to lessen the tendency of garage doors to reverse when closing as might otherwise be caused by ice and slow building up on the garage floor and bottom of the garage door.

Another object of the present invention is to lessen the strain on garage doors and garage door openers.

Lastly, it is an object of the present invention to provide a new and improved garage door opening and closing system comprising a lower bar pivotably connected to a garage door at an upper extent thereof and an associated intermediate bar for coupling with respect to the lower bar, an upper bar having an upper end pivotably connected to a door actuator and having a lower end with a piston mounted thereto, a cylindrical housing encompassing the piston with an apertured upper cap at the top end slidably receiving the upper bar with an apertured lower cap releasably secured to the upper end of the intermediate rod, and an upper coil spring mounted between the piston and the upper cap and a lower coil spring located between the piston and the lower cap.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a side elevational view of the new and improved garage door opening and closing system constructed in accordance with the principles of the present invention.

FIG. 2 is an enlarged side elevational view of the central components of the system shown in FIG. 1.

FIG. 3 is an end view of the device taken along line 3—3 of FIG. 2.

FIG. 4 is a cross-sectional view taken along line 4—4 of FIG. 3.

The same reference numerals refer to the same parts through the various Figures.

DESCRIPTION OF THE PREFERRED EMBODIMENT

Figure 5:
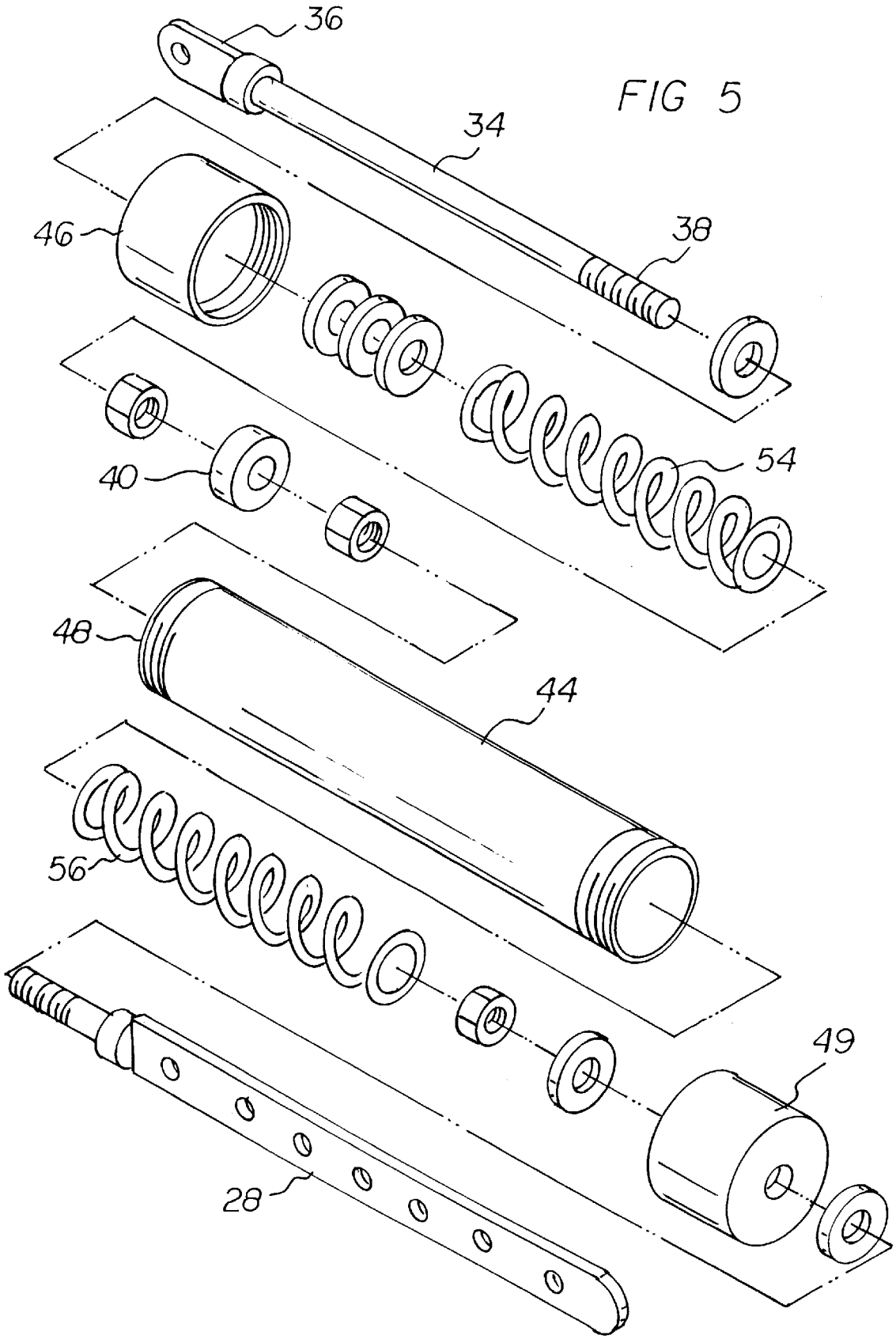
FIG. 5 is an exploded perspective view of the system shown in the prior Figures.

With reference now to the drawings, and in particular to FIG. 1 thereof, the preferred embodiment of the new and improved garage door opening and closing system embodying the principles and concepts of the present invention and generally designated by the reference numeral 10 will be described.

The present invention, the garage door opening and closing system 10 is comprised of a plurality of components. Such components in their broadest context include a lower pivot bar, an upper bar, a cylindrical housing, and an upper coil spring. Such components are individually configured and correlated with respect to each other so as to attain the desired objective.

A garage 14 has a generally vertical opening 16. The garage has a garage door 18. The garage door is moveable between a closed position covering the opening and an elevated orientation to open the opening. A rail 20 is horizontally positioned adjacent the top of the opening. The rail extends perpendicularly away from the top of the opening. Next provided is a slider 22. The slider is moveable along the rail to effect opening and closing of the door.

Next provided is a lower bar 26. The lower bar is in a generally L-shaped configuration. The lower bar is pivotably connected to the door at an upper extent thereof. The lower bar is also connected to an associated intermediate bar 28. The intermediate bar is provided with apertures 30 for coupling with respect to the lower bar at a preselected orientation.

Next provided is an upper bar 34. The upper bar is in a cylindrical configuration. The upper bar has an upper end 36 pivotably connected to the slider. The upper bar also has a threaded lower end 38. A piston 40 is mounted to the upper bar by nuts.

A cylindrical housing 44 encompasses the piston. The cylindrical housing is provided with an apertured upper cap 46 at the top end 48. The apertured upper cap slidably receives the upper bar. The cylindrical housing also has an apertured lower cap. The lower cap 49 is releasably secured to the upper end of the intermediate rod by nuts 50.

Lastly provided are an upper coil spring 54 and a lower coil spring 56. The upper coil spring is mounted between the piston and the upper cap. The lower coil spring 56 is located between the piston and the lower cap. In this manner motion of the slider toward the door will urge the upper, lower and intermediate rods and cylinder as well as the door downwardly with the urging of the piston toward the lower coil spring and with the piston adapted to locate itself between the springs upon the final sealing of the lower edge of the door within the opening.

From the foregoing it will be understood that the present invention defines a supplemental feature for existing garage doors or new garage doors, particularly those types of doors operated by garage door openers, which might be easily installed and utilized. The invention thus functions to maintain a light spring-loaded pressure on garage doors when in the closed position which increases the efficiency and safety and also eliminates or reduces the rattling of garage doors which might otherwise occur through the action of strong winds or the like. In addition, the present invention will lessen the tendency of garage doors to reverse when closing due to ice and snow buildup on the garage floor and/or bottom of the garage door. Lastly, the present invention will lessen the strain on garage doors and garage door openers.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A garage door opening and closing system comprising, in combination:

a garage having a generally vertical opening with a garage door moveable between a closed position covering the opening and an elevated orientation to open the opening, a rail horizontally positioned adjacent the top of the opening and extending perpendicularly away therefrom with a slider moveable along the rail to effect opening and closing of the door;

a lower bar in a generally L-shaped configuration pivotably connected to the door at an upper extent thereof and an associated intermediate bar with apertures for coupling with respect to the lower bar at a preselected orientation;

an upper bar in a cylindrical configuration having an upper end pivotably connected to the slider and having a threaded lower end with a piston adjustably mounted thereto by nuts;

a housing with an imperforate cylindrical side wall encompassing the piston with an upper cap threadably coupled to the housing at the top end formed with a central aperture slidably receiving the upper bar and having an apertured lower cap threadably coupled to the housing with an interior face and an exterior face releasably and adjustably secured to the upper end of the intermediate rod by nuts; and an upper coil spring located within the side wall between the piston and the upper cap and a lower coil spring located within the side wall between the piston and the lower cap in contact with the interior face therreof whereby motion of the slider toward the door will urge the upper, lower and intermediate rods and cylinder as well as the door downwardly with the urging of the piston toward the lower coil spring and with the piston adapted to locate itself between the springs upon the final sealing of the lower edge of the door within the opening.

* * * * *